United States Patent [19]

Virog, Jr. et al.

[11] 4,127,206

[45] Nov. 28, 1978

[54] MILK BOTTLES

[75] Inventors: John J. Virog, Jr., Massapequa Park; Leo Von Hagel, North Massapequa, both of N.Y.; Richard L. Platte, Ann Arbor, Mich.

[73] Assignee: Honeywell Farms, Inc., New York, N.Y.

[21] Appl. No.: 829,966

[22] Filed: Sep. 1, 1977

Related U.S. Application Data

[63] Continuation of Ser. No. 731,294, Oct. 12, 1976, Pat. No. 4,046,275.

[51] Int. Cl.[2] ..... B65D 23/00

[52] U.S. Cl. ..... 215/1 C; 215/100 A

[58] Field of Search ..... 215/1 C, 100 A, 31

[56] References Cited

U.S. PATENT DOCUMENTS

| | | | |
|---|---|---|---|
| 3,434,635 | 3/1969 | Mason | 215/1 C |
| 3,443,710 | 5/1969 | Hills | 215/100 A |
| 3,708,082 | 1/1973 | Platte | 215/1 C |
| 3,784,040 | 1/1974 | Douglas | 215/1 C |

*Primary Examiner*—R. E. Hart

*Attorney, Agent, or Firm*—Abner Sheffer

[57] ABSTRACT

A three-quart thin-walled blow molded plastic milk bottle of novel and useful construction.

15 Claims, 8 Drawing Figures

MILK BOTTLES

This is a continuation of application Ser. No. 731,294 filed Oct. 12, 1976 now U.S. Pat. No. 4,046,275.

This invention relates to a three-quart thin-walled blow-molded plastic milk bottle of special design.

Blow molding of plastic bottles is well known in the art. See for instance the book "Blow Molding" by Jones and Mullen published 1961 by Reinhold Pub. Corp. N.Y. and the article on "Molding, Blow Molding" in Encyclopedia of Polymer Science and Technology, Volume 9 published 1968 by Interscience. Thin-walled light weight milk containers have been made commercially, as described in the article entitled "An Investigation of Lighter Weight Milk Containers" at pages 36, 38, 40, 60, 61, 62 of the April 1974 issue of American Dairy Review. Such light weight bottles have been used commercially in gallon, three quart and half gallon sizes, and have the generally square shape shown in FIGS. 6 and 8 on page 60 of the American Dairy Review article.

Light weight blown bottles are far from rigid structures. Thus, as pointed out in the article in American Dairy Review, they tend to deform under load. In fact the force involved in pushing against the side of such a bottle to convey it, e.g. on the filling line, causes a very noticeable change in the milk level in the bottle (the walls, though cloudy, are translucent and the liquid level, even in a capped bottle, may thus be readily visible through the bottle walls).

Milk bottles are conventionally transported from the dairies to retail outlets in rectangular cases, whose interior dimensions are about 12 inches × 18 inches by 10¼ inches high. These cases are standard in much of the industry; the bodies of trucks employed to transport them and the dimensions of conveyors used to handle them are similarly standardized to conform to the standard case size.

When the known thin walled plastic three-quart milk bottles are filled with milk and loaded into a standard milk case, it is found that only some 18 quarts (6 bottles) will fit in the case. In comparison a standard case will hold 24 conventional one quart paper milk containers.

Certain aspects of this invention relate to novel thin walled plastic blow-molded three-quart milk bottles which readily fit, when filled, 24 or more (e.g. 27) quarts in a standard case, and which are so constructed that they are easy to handle, exceptionally easy to pour, store easily in many conventional refrigerator door shelves, retain their shape and size well and can be made simply by conventional blow molding procedures with a minimum of operations.

One preferred embodiment of the invention is illustrated in the accompanying drawings showing (substantially to scale, the scale for all FIGS. being the same) the interior volume, or cavity, of a mold for the making of the bottles. The mold is in two identical halves which are brought together (in conventional fashion) around the plastic parison which is being blown into contact with the mold. The parting line of the two mold halves (which parting line is thus an axis of symmetry, or a diameter) runs vertically down the middle (center of symmetry) of FIG. 2, and concomitantly horizontally across the center of symmetry of FIGS. 3 and 4. In the drawings FIG. 1 is a side view of the cavity of the main mold and of a neck ring used therewith. To illustrate the configuration of the mouth of the blown bottle a cross-sectional view of a portion of the mouth is superimposed at the appropriate area of FIG. 1

Figure 1:
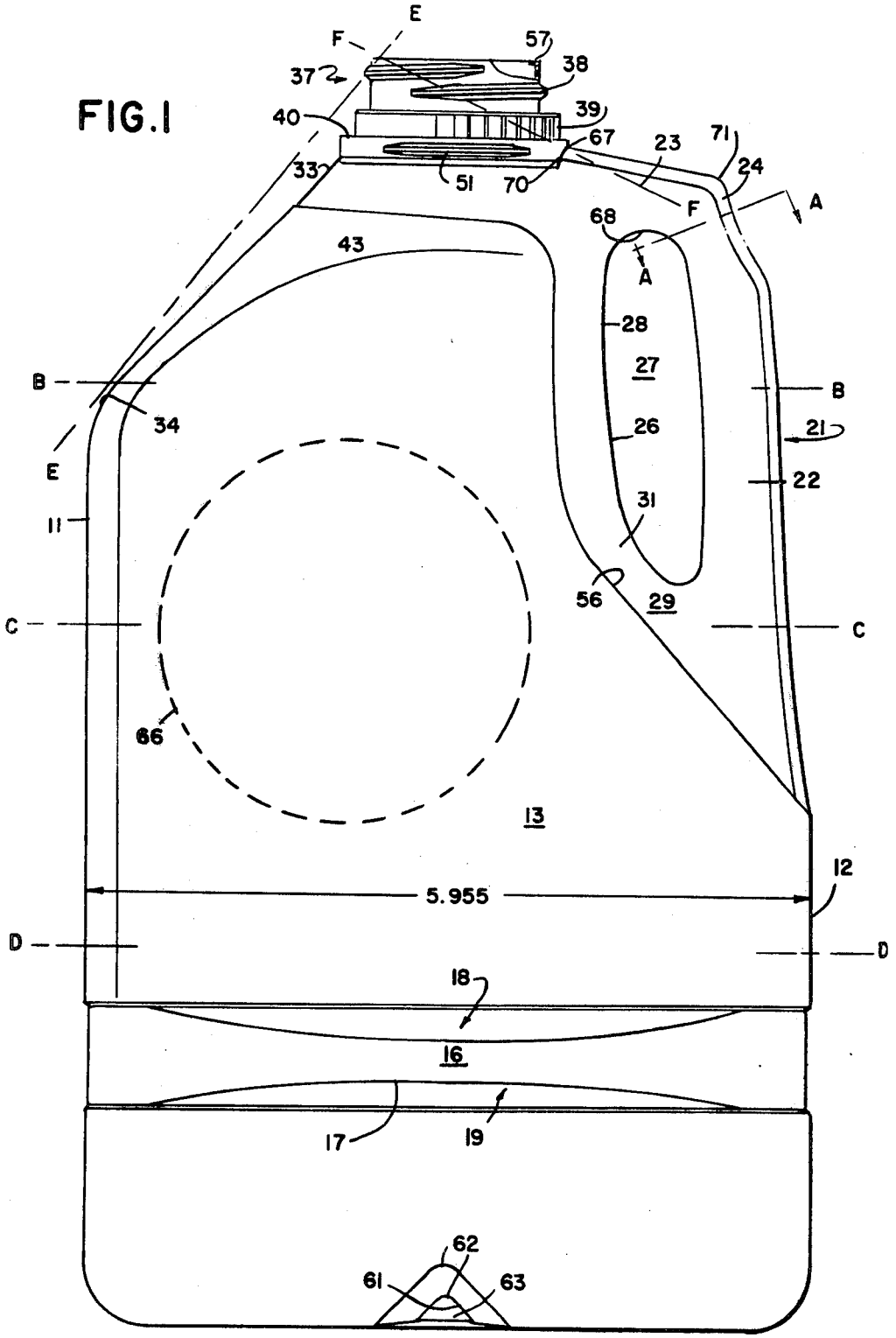

As indicated above, the drawing shows the mold cavity. This is substantially the same as the exterior of the bottle blow-molded from such a mold, except that (as is well known in the art) some shrinkage (such as a 1–2% shrinkage in linear dimensions, of the bottle occurs on removal from the mold and additional shrinkage may occur on standing for some period of time (e.g. a day) before filling while bulging and/or stretching occurs on filling. These shrinkage and stretching factors are discussed in the American Dairy Review article mentioned above. The unfilled, uncapped weight per bottle is less than 60 grams such as about 45–55 grams, e.g. about 48–50 grams. At these weights the wall thickness may be, for example, about 0.3 or 0.4 mm. The bottles are preferably molded of the high density polyethylene conventionally employed for plastic milk bottles. It is also within the broader scope of the invention to use other polyolefins such as conventional stereoregular polypropylene.

Figure 6:
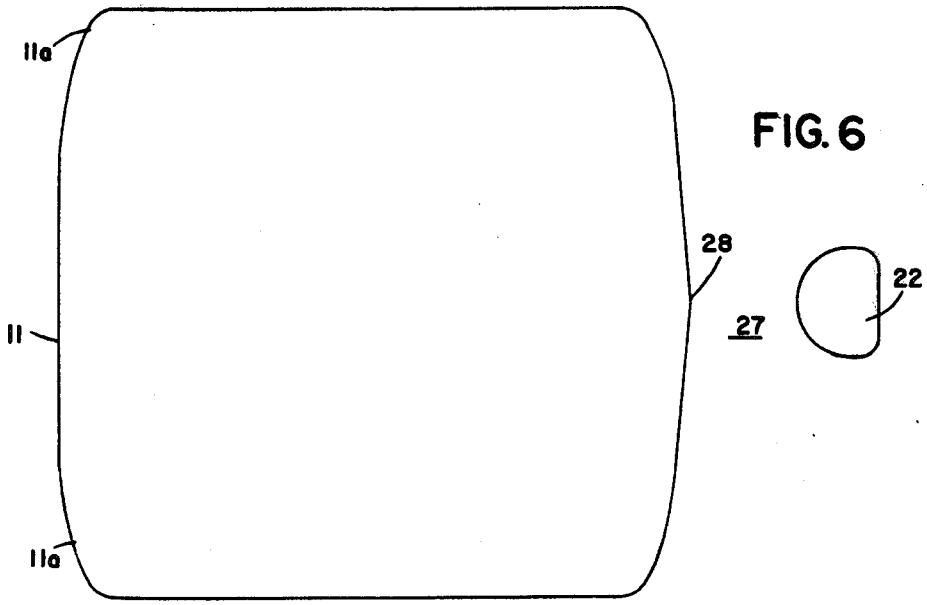
Figure 7:
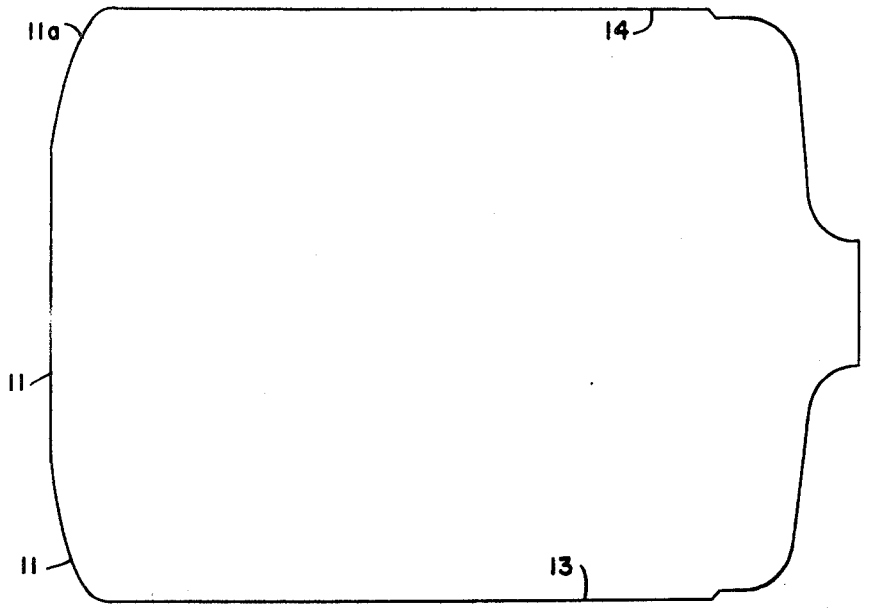
Figure 8:
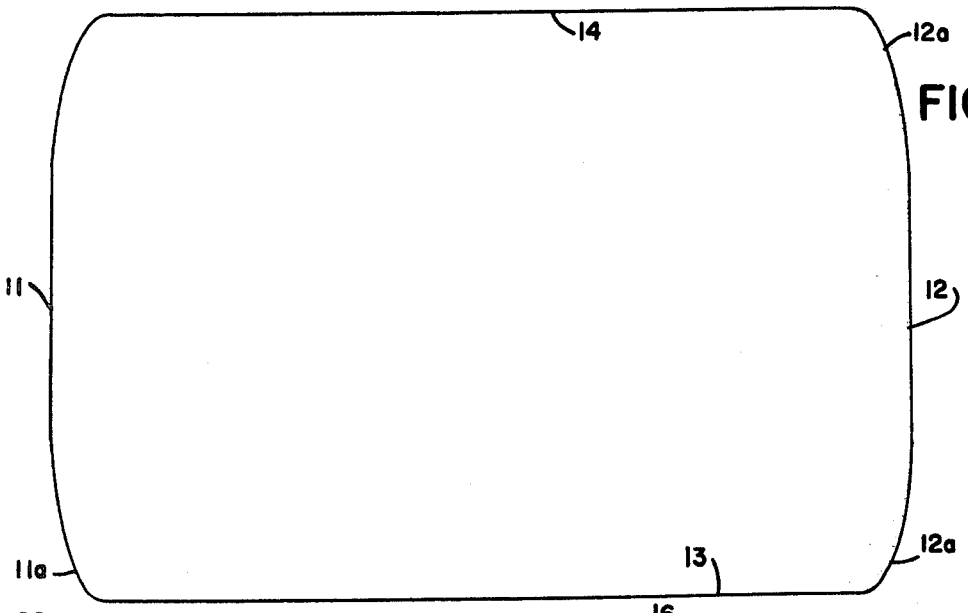

The illustrated bottles are almost 10 inches (e.g. 9⅞ inches) high. The horizontal cross section of their lower portion (to a height of about 4½ inches) is substantially rectangular with rounded corners. The bottle has a 4 inch wide front wall 11, a 4 inch wide lower rear wall 12 and two almost six inch wide (e.g. 5.955 inch mold width) side walls 13, 14. Preferably the front wall 11 and lower rear wall 12 are each curved gradually near the corners as shown at 11*a* and 12*a* in FIGS. 6, 7 and 8 while the side walls 13, 14 are substantially straight throughout their lengths. It is found that the front and rear walls do not bulge significantly when the bottle is filled, thus permitting a pair of filled bottles to be placed end to end in the 12 inch width of a standard dairy case (with the 6 inch side walls 13, 14 parallel to the 12 inch side of the dairy case), so that four such pairs can be fitted into the case.

Figure 4:
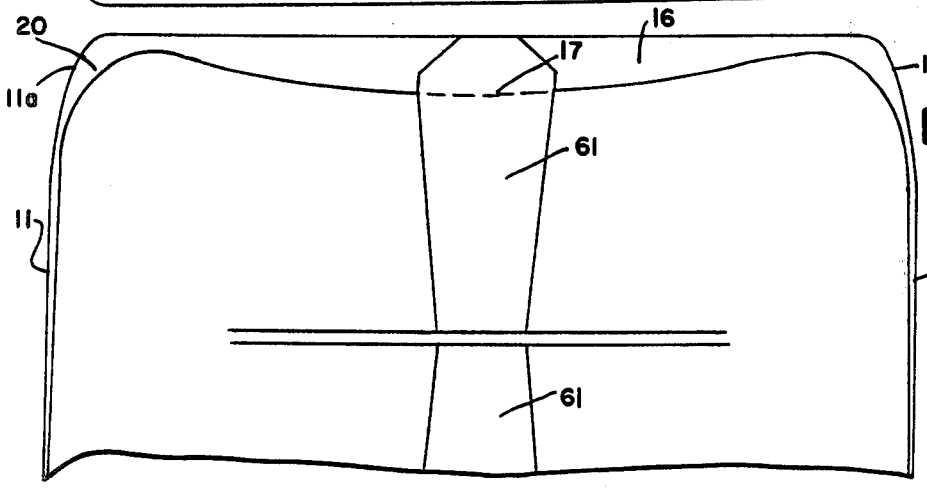
FIG. 4 is a partial bottom view, the broken-off portion being symmetrical with the portion shown.

Each of the side walls 13, 14 is stiffened (against bulging under the weight of the milk in the bottle) by a wide internally projecting substantially horizontal band 16 which extends around the corners. This band is preferably of continuously varying depth along the side 13 or 14, projecting inwardly to its greatest extent midway between the corners (at 17) and tapering toward the corners; see also FIG. 4. Thus in the illustrated embodiment each band 16 has a width (measured vertically) of about ¾ inches and has a depth (i.e. the extent to which it projects inwardly, horizontally) of over ¼ inch, preferably about ⅜ inch, at its midpoint and has sloping top and bottom faces, 18 and 19 so that its cross-section in a vertical plane may be described as trapezoidal. At the corners the depth of the inwardly projecting band is about ¼ inch (as shown at 20 in FIG. 4). For decorative purposes the band may continue all around the periphery, being very shallow (e.g. 1/32 inch deep) along the front and lower rear walls. As indicated above this band acts very effectively to prevent undue bulging of the longer side walls despite the thin-walled construction. Some outward curving of the side walls 13, 14 does occur; for instance the side walls of a filled bottle may curve outward so that, at a level about 4 inches above the base, the center of the side wall may be displaced about ¼ inch horizontally from the vertical plane which passes through the top and bottom of the side wall. This does not however significantly affect the appearance of the filled bottle or its ability to be packed eight to a standard milk case. The substantial depth of the band 16 at the corners (a depth of more than one-eighth inch, such as one-fourth to three-eights inch) helps to prevent dimpling where the band meets the corners. The width of the inwardly projecting band is preferably about ½ to 1 inch and it is situated at a level below the base of the handle (described below) and substantially above the base of the bottle (e.g. about halfway between the base of the handle and the base of the bottle.

The upper portion of the bottle includes a hollow handle 21 centered on the rear wall and preferably about three-fourths inch wide. This handle comprises a substantially vertical main upright portion 22 (e.g. inclined at about 5° to the vertical) and a gently sloping (e.g. 10° to horizontal) upper portion 23. Preferably at the top of the upright portion the outer surface is curved concavely to provide a thumb-engaging portion 24 for those users who like to squeeze the top of the upright portion of the handle between thumb and forefinger. Between the upright portion 22 and the adjacent upper rear wall 26 of the bottle there is a substantially vertical finger receiving space 27 which may be about 0.6 inch wide and about 4¼ inches in height, smoothly curved at top and bottom; this accommodates, snugly, the four fingers of most hands.

It will be seen that there is a substantially vertical portion 28 of the upper rear wall 26 which is adjacent the handle and is adapted to be engaged by the knuckle-side portions of the first (index) finger, second finger and third finger. This portion 28 may be substantially planar but is preferably, as shown, symmetrically crowned at an angle of about 170° C (180° minus twice 5° C, as shown). Below that the substantially vertical portion 28 the upper rear wall has a portion 29 which is inclined to the vertical at an angle in the range of about 30–45° (preferably about 40° as shown) as shown, and there is a smoothly curved transition portion 31 (joining the portions 28 and 29) adapted to be engaged by the fourth finger.

On the pouring side of the bottle (i.e. the side opposite to the handle side) the front wall 11 extends upward, from the base, for a height of at least about 6 inches (e.g. about 7 inches as shown) and then meets an upper wall 33 along a rounded edge 34, the portion of the upper wall 33 between the spout of the bottle and edge 34 is preferably substantially planar and inclined at an angle of about 45°.

The spout 37 of the bottle may be of conventional construction, e.g. a screw threaded portion 38 having a ratchet 39 for interacting with a ratcheting locking cap (as shown for instance in U.S. Pat. No. 3,504,818 or 3,812,994. Generally it is about ½ inch (e.g. 0.6 inch) in height. It is located at substantially the midpoint of the rectangular cross-section of the bottle. In blowing the bottle, the conventional procedures for on-center blowing can be used without any need for the various additional steps which would be required in off center blowing. The bottle is generally blown into a three-part mold. One part of the mold forms the main body of the bottle from the shoulder 40 down to a level just above the base (e.g. halfway between the bottom of band 16 and the bottom of the bottle). Another part forms the bottom of the bottle. The third mold part is the "neck ring" which forms the spout portion, above shoulder 40.

The illustrated bottle has been found to have exceptionally good pouring characteristics even when full. While the reasons for this are not clear, it is believed that it is due to the combination of the substantially upright handle and the particular angle (about 40°, e.g. 42°, to the vertical) of the imaginary line E — E passing through the inner edge of the top of the spout and the intersection of front wall 11 and top wall 33, taken with the fact that the construction is such that a free passage is established for air to pass from the spout into the handle before significant pouring begins. This latter aspect will be discussed more fully below.

The side walls 13 and 14 are substantially vertical and planar until a level just below the spout where they meet the side portions 43, 44 of the upper wall at rounded edges 47, the upper wall being inclined to the horizontal at about 30°–40°, such as the 34° shown in the drawing.

At the base of the spout there are preferably lugs 51, 52 formed in the thin walls; these serve as grippable elements for mechanical conveying (e.g. lifting) of the bottles to facilitate packing the bottles into the cases.

Figure 2:
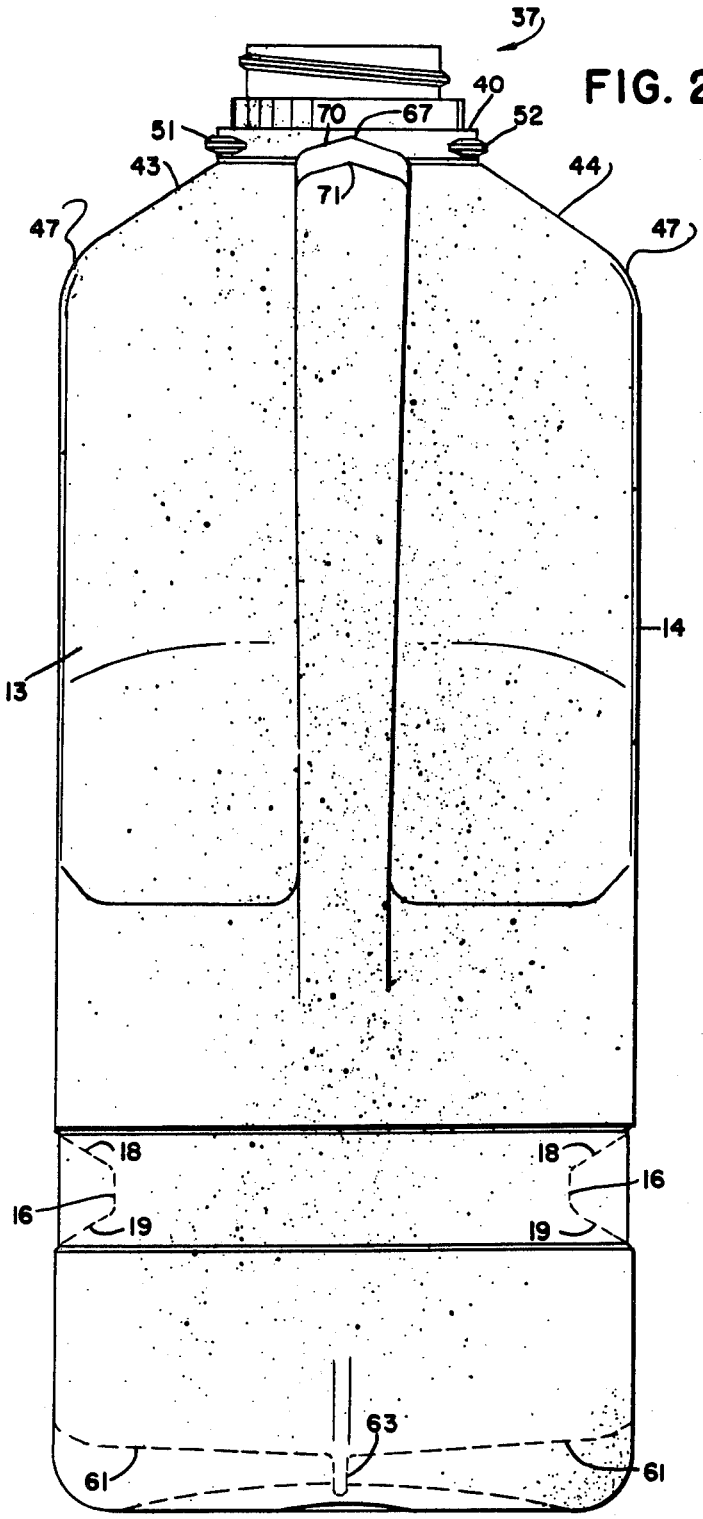
FIG. 2 is another side view looking at the right hand side of FIG. 1.
Figure 5:
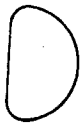
FIGS. 5, 6, 7 and 8 are views taken along the lines A—A, B—B, C—C and D—D, respectively, of FIG. 1.
Figure 3:
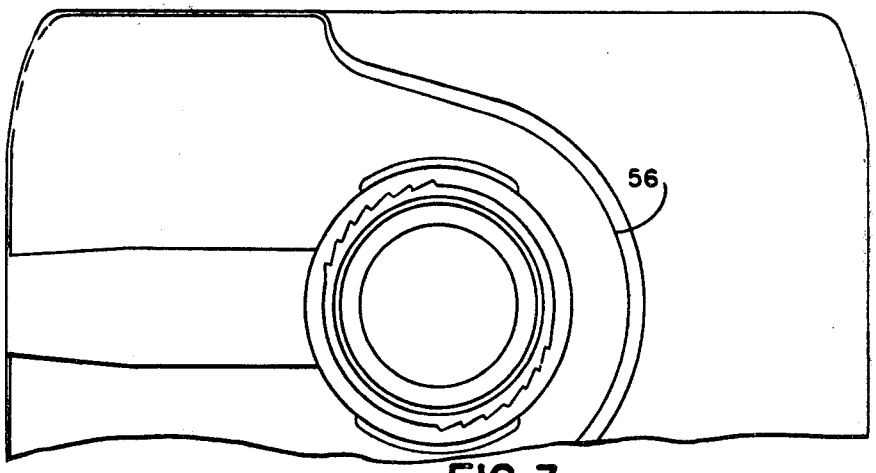
FIG. 3 is a partial top view of FIG. 1, the broken-off portion being symmetrical with the portion shown.

The base of the bottle may be suitably constructed for good pinch-off characteristics during molding and also to resist deformation. Thus there may be an angular release groove 61, whose apex 62 tapers upwardly from the central pinch-off zone (as seen in FIG. 2) at which there is formed a web-like narrow external rib 63 which intersects the groove 61 as shown. This construction does not in itself form a part of the present invention.

Even though the bottle is very light and has very thin walls it is rugged and readily withstands the mechanical operations involved in filling, loading, unloading, etc. As an indication of the very light construction, if a full or almost full bottle is turned upside down and held vertically while the contents are allowed to run out, the atmospheric air pressure collapses the side walls to a considerable degree, bowing them in so that at their centers they are some 3 inches (or less) apart rather than about 4 inches apart.

After molding the bottles may (after trimming of flash and decorating, as by printing) be filled directly or some time thereafter. Certain adjustments to the mold cavity will generally be made to bring the capacity of the bottle to very close to the three-quart standard. Such volume adjustments are conventional, as described in the previously cited article in American Dairy Review; a quickly changeable volumetric insert of the type there described for this purpose is illustrated by dotted lines (in FIG. 1) marked 66. Another, and preferred, technique is to effect a controlled pre-shrinkage of the bottle in an oven, to bring the bottle to such a volume that, when the preshrunk bottle is filled with precisely three quarts (plus a fraction of an ounce, e.g. one-eighth – one-fourth ounce) while standing free and then moved through a capping machine and capped (with a standard cap), the liquid level is just about at the bottom of the ratchet section 39 and is thus not visible.

When the consumer breaks the airtight seal on the cap the liquid level falls. This results from the fact that, in the capping process, the bottles may be engaged by conveying elements (such as arms of a star wheel) which push in against the flexible walls of the bottles and thus raise the liquid level; when the conventional airtight cap is placed on the bottle the liquid level remains at substantially that new height even when the bottle is standing free, owing to the effect of air pressure on the flexible walls. When the cap is unscrewed, the liquid level of course drops noticeably from that new height; then when the bottle is lifted by the handle the level drops still more, presumably because the unsupported bottom then bulges out somewhat under the weight of the contents. Even on the first pouring the liquid level can readily be seen (when the bottle is tilted to pour it) within the upper portion 23 and upright portion 22 of the handle 21.

The following example may help to illustrate the characteristics of the bottle with respect to the smooth flow of liquid, and related free passage of air into the handle, even on initial pouring. In this example the amount of liquid in the capped bottle is constant and is such that when the cap is removed the liquid level falls (as described above) to a height at which about half of the volume of the spout is occupied by the liquid. (In practice, as previously mentioned, this level will generally be even lower). When the bottle is then lifted by the handle, in such fashion as to maintain the bottle vertical the liquid level falls to almost the bottom of the spout, i.e. to about or just above (e.g. 1 mm above) the level of the inside of crest 67. Of course, in lifting the bottle by hand it is easier not to keep the bottle vertical but instead allow it to take its natural balanced tilt owing to the off-axis location of the handle. When he bottle is lifted in such a manner that it is balanced about the first finger held in the round finger-receiving portion 68 at the top of space 27, the bottle tilts so that the front and rear walls 11, 12 are at an angle of about 25° to the vertical; at this tilt the line of the top of the liquid passes through the handle and there is a free clear air passage from the spout through the upper portion 23 of the handle. This free clear air passage is present even when the tilt is much less, e.g. about 10°. At the 25° tilt mentioned above the level of the liquid closest to the pouring lip is some distance (e.g. about 3 mm) below the pouring lip, and thus no pouring occurs; of course, at the 10° tilt the liquid level is still further below the pouring lip. It should be noted that static analysis does not fully explain what happens in the dynamic process of pouring; thus, in pouring, the liquid does not merely dribble over the edge of the pouring lip but forms a stream which arches outward from the lip.

In FIG. 1 line F — F is an imaginary unobstructed minimum slope diametral line from the pouring edge of the spout into the interior of the handle; this line passes just below the highest part (crest 67) of the spout adjacent crowned portion 69 of the upper part 23 of the hollow handle.

It is noted that this line F — F has a slope of less than 30°, e.g., about 25°, or less, as illustrated. Thus when the tilt is equal to the previously mentioned "natural" tilt of about 25°, the line F — F of FIG. 1 becomes substantially horizontal, while the line E —E of FIG. 1 makes an angle of about 15° to the vertical.

Generally the slope of F — F will be above about 20°.

As seen in FIG. 1 the top of the upper part 23 of the hollow handle extends radially from the crest 67 (which is at or just below the shoulder 40) along a line which is substantially horizontal (e.g. sloping downward slightly at about 10°), its slope being much less than that of the upper wall 33. The position of crest 67 is radially inward of the finger receiving space 27 (and of the upper rear wall portion 28 bounding that space; thus the spacing, from the axis of the spout, may be about 1 inch, e.g. 0.95 inch, for the crest 67 and about 1.3 inches for wall 28). The crowning (shown by line 70 in FIG. 2) of the portion of the handle near the shoulder 40 insures that there is a free path for the flow of air into the handle on initial pouring, as described above. It is within the broader scope of the invention for that portion of the handle to be un-crowned; e.g. the line 70 where the handle meets the main body of the bottle may be substantially horizontal and at the level of crest 67, although such a construction may require more care in removing the bottle from the mold. While, in the preferred embodiment, the mold is structured to provide a crown 71 at the outer portion of the top of the upper part 23 of the handle, the bottle usually does not retain that crown and assumes a substantially flat configuration at that point.

For a preferred mold cavity, the width at the parting line is 5.955 inches (as indicated in FIG. 1) while the width, at the center in a plane (FIG. 2) perpendicular to the plane of the parting line, is 4.010 inches, the height to shoulder 40 is 9.442 inches, the outside diameter of the circular shoulder 40 is 1.916 inches, the height of the "neck ring" is about 0.59 inch and the outside diameter of the neck ring at the pouring lip is about 1.37 inch.

The bottles may have various esthetic or informative configurations. For instance, there may be a low shoulder 56 encompassing handle and spout areas.

In FIG. 1 the broken-away portion of the spout shows a lip 57 at the rim. This is formed when the blowing apparatus uses a well known pull-up type of blow pin and shear steel. Other rim formations (such as bead) which are produced with other conventional blow pins and shear steels are well known in the art and may be employed instead of the lip 57.

Rectangular three quart containers of paper, without handles, are known in the art. These also fit 24 or more in a standard dairy case.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

We claim:

1. A blow-molded light-weight thin-walled plastic milk bottle having a volume of substantially three quarts and weighing less than 60 grams, having a substantially rectangular 4 inch by 6 inch cross-section having a 4 inch wide front wall, a 4 inch wide lower rear wall parallel to said front wall and two parallel 6 inch wide side walls at right angles to said front and lower rear walls, said front, lower rear and side walls being substantially vertical and substantially planar, said container having a central squat generally cylindrical upright spout, said spout having an upper mouth opening and having a screw thread therebelow, said mouth opening being adapted to be tightly closed by a correspondingly threaded plastic cap, said bottle having an integral continuously hollow handle centrally positioned, with respect to said lower rear wall, and an upper rear wall spaced horizontally from said handle, said handle having a substantially vertical main upright portion whose base is adjacent to said lower rear wall, said upright portion being spaced from said upper rear wall sufficiently to provide space for a plurality of fingers of a hand, side-by-side in vertical array, the top of said upright handle portion communicating with a gently sloping upper generally horizontal handle portion which communicates with the bottle just below said spout, said bottle having an inclined top wall which intersects said front wall and said side walls, the inclination of said top wall being such that the imaginary diametral line from the pouring edge of said spout to the point where said front wall meets said inclined top wall makes an angle of about 40° to the vertical.

2. A bottle as in claim 1 made of high density polyethylene and weighing about 45 to 55 grams.

3. A bottle as in claim 2 weighing about 48 to 50 grams.

4. A blow-molded light-weight thin-walled plastic milk bottle having a volume of substantially three quarts and weighing less than 60 grams, having a substantially rectangular 4 inch by 6 inch cross-section having a 4-inch wide front wall, a 4 inch wide lower rear wall parallel to said front wall and two parallel 6 inch wide side walls at right angles to said front and lower rear walls, said front, lower rear and side walls being substantially vertical and substantially planar, said container having a central squat generally cylindrical upright spout, said spout having an upper mouth opening and having a screw thread therebelow, said mouth opening being adapted to be tightly closed by a correspondingly threaded plastic cap, said bottle having an integral continuously hollow handle centrally positioned with respect to said lower rear wall and an upper rear wall spaced horizontally from said handle, said handle having a substantially vertical main upright portion whose base is adjacent to said lower rear wall, said upright portion being spaced from said upper rear wall sufficiently to provide space for a plurality of fingers of a hand, side-by-side in vertical array, the top of said upright handle portion communicating with a gently sloping upper generally horizontal handle portion which communicates with the bottle just below said spout, said bottle having an inclined top wall which intersects said front wall and said walls, each of said side walls having an inwardly projecting substantially horizontal band which varies in depth being deepest at a zone about midway between the vertical edges of said side walls, said inwardly projecting band extending around said edges.

5. A bottle as in claim 4 in which said band has a width of about ½ to 1 inch, has an inwardly projecting depth of over one-fourth inch at said midway zone, and has a trapezoidal cross section.

6. A bottle as in claim 4 made of high density polyethylene and weighing about 45 to 55 grams.

7. A bottle as in claim 5 weighing about 48 to 50 grams.

8. A bottle as in claim 5 made of high density polyethylene and weighing about 45 to 55 grams, the inclination of said top wall being such that the imaginary diametral line from the pouring edge of said spout to the point where said front wall meets said inclined top wall makes an angle of about 40° to the vertical.

9. A bottle as in claim 8 in which the portion of said inclined top wall which is between said spout and an edge where it intersects said front wall is substantially planar and at an angle of about 45° to the vertical.

10. A bottle as in claim 1 in which said upper handle portion is so situated that the imaginary unobstructed minimum slope diametral line from said pouring edge into said upper handle portion has a slope of less than 30°.

11. A bottle as in claim 10 in which said slope is about 25° or less.

12. A bottle as in claim 10 in which said slope is about 20 to 25° and said upper handle portion is crowned along a line where it meets said top wall, said meeting line being spaced inwardly of said upper rear wall.

13. A bottle as in claim 12 in which said upper rear wall is spaced about 1.3 inches from the axis of said spout and said meeting line is spaced about 1 inch from said axis.

14. A bottle as in claim 5 in which said band is situated about halfway between the base of said handle and the base of said bottle.

15. A bottle as in claim 9 in which said band is situated about halfway between the base of said handle and the base of said bottle.

* * * * *

UNITED STATES PATENT OFFICE

CERTIFICATE OF CORRECTION

Patent No. 4,127,206 Dated November 28, 1978

Inventor(s) John J. Virog, Jr. et al.

It is certified that error appears in the above-identified patent and that said Letters Patent are hereby corrected as shown below:

On the cover sheet add:

-- The portion of this patent subsequent to September 6, 1994 has been disclaimed --.

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*